United States Patent [19]

Tanner

[11] 4,389,262

[45] Jun. 21, 1983

[54] AMORPHOUS ALLOYS OF NICKEL, ALUMINUM AND BORON

[75] Inventor: Lee E. Tanner, Berkeley, Calif.

[73] Assignee: Allied Corporation, Morris Township, Morris County, N.J.

[21] Appl. No.: 221,941

[22] Filed: Dec. 31, 1980

[51] Int. Cl.[3] ..... C22C 19/03

[52] U.S. Cl. ..... 148/403

[58] Field of Search ..... 75/170; 148/32, 403

[56] References Cited

U.S. PATENT DOCUMENTS 3,838,365 9/1974 Dutoit ..... 333/30 R
3,856,513 12/1974 Chen et al. .
4,036,638 7/1977 Ray et al. .
4,052,201 10/1977 Polk et al. ..... 75/124

FOREIGN PATENT DOCUMENTS 2398809 2/1979 France .

OTHER PUBLICATIONS

Scripta METALLURGICA, vol. 9, pp. 431–436, 1975, "Hardness/Strength Ratio of Metallic Glasses," L. A. Davis.

Z. Metallkde, pp. 326–328, 1962, "Metallspharolithen im System Nickel–Aluminium–Bor," Schobel and Stadelmaier.

METALL, vol. 16, pp. 212–214, 1962, "Die Nickelecke des ternaren Systems Nickel–Aluminium–Bor," Stadelmaier and Fraker.

Trans. JIM, vol. 20, pp. 404–406, 1979, "Ni–B and Co–B Amorphous Alloys with High Boron Concentration," Inoue, Kitamura and Masumoto.

*Primary Examiner*—R. Dean

*Attorney, Agent, or Firm*—Michael J. Weins; Gerhard H. Fuchs

[57] ABSTRACT

Amorphous nickel, aluminum, and boron alloys are described. These alloys are characterized by high hardness and high crystallization temperatures.

3 Claims, 1 Drawing Figure

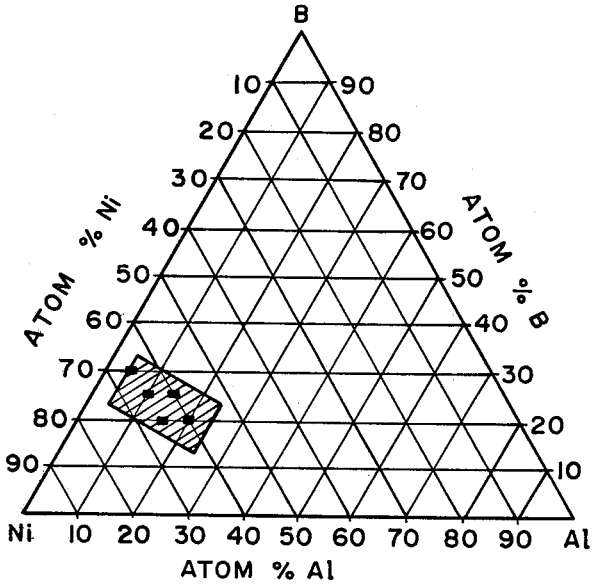
B
10
20
30
40
50
60
70
80
90
90
80
70
60
50
40
30
20
10
ATOM % Ni
ATOM % B
Ni
10 20 30 40 50 60 70 80 90
Al
ATOM % Al

AMORPHOUS ALLOYS OF NICKEL, ALUMINUM AND BORON

DESCRIPTION

1. Field of Invention

The invention relates to amorphous metal alloy compositions and, in particular, the compositions comprising nickel, aluminum, and boron which have high crystallization temperatures and high hardness.

2. Description of the Prior Art

Amorphous alloys which contain substantial amounts of one or more of the elements from the group of iron, nickel, cobalt, vanadium and chromium, and may in addition contain limited amounts of aluminum, have been described by H. S. Chen and D. E. Polk in U.S. Pat. No. 3,856,513. They found that these alloys had crystallization temperatures in the range of about 425° C. to 550° C. and had hardness values between about 600 and about 750 DPH (Diamond Pyramid Hardness).

Recent work by R. Ray and S. Kavesh on iron boron alloys has produced amorphous materials with hardness values from about 1,000 to 1,290 DPH, and with crystallization temperatures ranging from about 454° C. to 486° C. This work is described in U.S. Pat. No. 4,036,638.

SUMMARY OF THE INVENTION

It is an object of this invention to provide amorphous alloys exhibiting high hardness.

Another object of this invention is to provide amorphous alloys with high thermal stability.

These and other objects of the invention will become apparent from the following description and claims.

The present invention provides high strength nickel, aluminum, boron alloys which are substantially amorphous. The ratio of these three constituents are maintained such that when the overall composition is plotted on a ternary phase diagram in atomic percent nickel, atomic percent aluminum and atomic percent boron, the compositions are within a region represented by a quadrilateral having its corners at the points defined by:

(1) Ni-62, B-33, Al-5;
(2) Ni-73, B-22, Al-5;
(3) Ni-62, B-13, Al-25; and
(4) Ni-52, B-23, Al-25.

BRIEF DESCRIPTION OF THE DRAWING

The FIGURE is a ternary phase diagram in atomic percent for the system nickel, aluminum and boron. The glass-forming region of the present invention is shown by the shaded quadrilateral.

BEST MODES OF CARRYING OUT THE INVENTION

The FIGURE is a ternary phase diagram of nickel, aluminum and boron in atomic percent. The shaded region, within the ternary diagram having corners at the indices (62, 33, 5), (73, 22, 5), (62, 13, 25), and (52, 23, 25), depicts a region of composition over which amorphous solids can be formed. An alloy is considered to be an amorphous solid when there is no appearance of a crystalline character in its X-ray diffraction pattern.

The alloys of the present invention are found to have a marked increase in hardness over the alloys described by Chen and Polk. Since tensile strength scales with hardness for metal glasses, this increase in hardness will provide alloy with superior ultimate tensile strength. L. A. Davis reports in *Scripta Metallurgica,* Vol. 9, pp. 431–436 (1975) that the sealing factor, hardness/-strength ratio, for metallic glasses is approximately 3.2.

The thermal stability of these nickel, aluminum, boron amorphous alloys is characterized by the time-temperature transformation of the alloys and can be characterized by DTA (Differential Thermal Analysis). DTA measurements allow the crystallization temperature, $T_c$, to be accurately determined. This is accomplished by heating an amorphous alloy at a slow rate, about 20° C. to 50° C. per minute, and noting over what limited temperature range there is an evolution of heat. The thermal stability of amorphous alloys is important since, if they are not thermally stable, a complete or partial transformation from the glassy state to an equilibrium or metastable structure may occur during subsequent processing or in service. As with inorganic oxide glasses, such transformations degrade physical and mechanical properties such as corrosion resistance, tensile strength, etc. The thermal stability of the alloys of the present invention are generally greater than those of the high strength materials reported by Ray et al.

There are many applications which require the alloy have high ultimate tensile strength and thermal stability. For example, metal ribbons used in razor blade applications usually undergo a heat treatment at about 370° C. for about 30 min. to bond an applied coating of polytetrafluoroethylene to the metal. For razor blades, the more stainless character of nickel base alloys over the iron base alloys of Ray et al. is also highly desirable.

EXAMPLES

Rapid melting and fabrication of amorphous ribbon strip having uniform width and thickness made from alloy compositions of the present invention was accomplished under vacuum. The vacuum was employed to minimize oxidation and contamination of the alloy during melting. The alloy was cast onto a copper cylinder which was mounted vertically on a shaft of a vacuum rotary feed through and placed in a stainless steel vacuum chamber. The vacuum chamber was a cylinder, flanged at two ends with two side ports, and was connected to a diffusion pumping system. The copper cylinder having a diameter of about 8 in. was rotated by a variable speed electric motor. The crucible was surrounded by an induction coil assembly and located above the rotating cylinder. An induction power supply was used to melt the alloy contained in a crucible made of fused quartz, boron nitride, alumina, zirconia, or beryllia. The amorphous ribbons were prepared by melting the alloy in a suitable non-reducing crucible and injecting the melt by an over pressure of argon through an orifice at the bottom of the crucible onto the surface of the rotating cylinder. The rotational speed employed was between about 1500 to 2000 rpm. The melting and casting was carried out in a vacuum where the pressure was about 100 micrometers, and an inert gas such as argon was used to adjust the vacuum pressure.

Using the vacuum melting and casting apparatus described above, a number of various glass-forming nickel, aluminum, boron alloys were chill cast as continuous ribbons having substantially uniform thickness and width. Typically, the thickness ranged from 0.001 to 0.003 inch and the width ranged from 0.05 to 0.12 inch. The ribbons were checked by X-ray diffraction and DTA to determine if they were amorphous. The DPH hardness was measured by the Diamond Pyramid technique using a Vickers-type indenter consisting of a diamond in the form of a square-based pyramid with inclination angle of 136° between opposite faces.

Alloys cast in fully glassy ribbon form by the technique described above are summarized in the following table. The composition of these alloys are illustrated by the square symbol in the FIGURE.

TABLE

| Alloy Composition (Atomic Percent) | Hardness kg/mm$^2$ | P gm/cc | Crystal-lization Temp °C. | UTS Pa × $10^9$ | UTS (psi × $10^5$) |
|---|---|---|---|---|---|
| $Ni_{65}B_{30}Al_{15}$ | 1086 | 7.70 | NA* | 3.328 | (4.82) |
| $Ni_{65}B_{25}Al_{10}$ | 988 | 7.34 | 457 | 3.028 | (4.39) |
| $Ni_{60}B_{20}Al_{20}$ | 1003 | 6.82 | 522 | 3.074 | (4.46) |
| $Ni_{65}B_{20}Al_{15}$ | 1018 | 7.32 | 482 | 3.119 | (4.52) |
| $Ni_{60}B_{25}Al_{15}$ | 1054 | 6.99 | 517 | 3.230 | (4.68) |

*not analyzed by DTA

What is claimed:

1. An amorphous nickel-base alloy containing aluminum and boron and having an ultimate tensile strength in excess of $3\times10^9$ Pa, the alloy consisting essentially of a composition which, when plotted on a ternary phase diagram in atomic percent Ni, atomic percent Al and atomic percent B, is represented by a quadrilateral region having at its corners the points defined by:

(1) Ni-62, B-33, Al-5;
(2) Ni-73, B-22, Al-5;
(3) Ni-62, B-13, Al-25; and
(4) Ni-52, B-23, Al-25.

2. The alloy of claim 1 wherein said region is further limited by the equation $Ni_aB_bAl_c$, wherein a, b, and c are atomic percents and have the following ranges of values:

a=60–70
b=20–30, and
c=5–20;

With the proviso that a+b+c=100.

3. The alloy of claim 2 wherein said alloy is selected from the group consisting of $Ni_{65}B_{30}Al_5$, $Ni_{65}B_{25}Al_{10}$, $Ni_{60}B_{20}Al_{20}$, $Ni_{65}B_{20}Al_{15}$ and $Ni_{60}B_{25}Al_{15}$.

* * * * *